US011425500B2

(12) United States Patent
Sellak

(10) Patent No.: US 11,425,500 B2
(45) Date of Patent: Aug. 23, 2022

(54) APPARATUS FOR GENERATING AUDIO SIGNAL TO COMPENSATE FOR MISSING COMPONENTS IN THE AUDIO SIGNAL

(71) Applicant: ASK INDUSTRIES GMBH, Niederwinkling (DE)

(72) Inventor: Benjamin Sellak, Niederwinkling (DE)

(73) Assignee: ASK INDUSTRIES GMBH, Niederwinkling (DE)

( * ) Notice: Subject to any disclaimer, the term of this patent is extended or adjusted under 35 U.S.C. 154(b) by 0 days.

(21) Appl. No.: 17/434,173

(22) PCT Filed: Oct. 21, 2019

(86) PCT No.: PCT/EP2019/078553
§ 371 (c)(1),
(2) Date: Aug. 26, 2021

(87) PCT Pub. No.: WO2021/078356
PCT Pub. Date: Apr. 29, 2021

(65) Prior Publication Data

US 2022/0103939 A1 Mar. 31, 2022

(51) Int. Cl.
*H04R 3/04* (2006.01)
*H04R 3/12* (2006.01)
*G10L 21/0388* (2013.01)

(52) U.S. Cl.
CPC ..... *H04R 3/04* (2013.01); *G10L 21/0388* (2013.01); *H04R 3/12* (2013.01); *G10H 2210/311* (2013.01); *G10H 2210/321* (2013.01); *H04R 2430/20* (2013.01)

(58) Field of Classification Search
CPC ..... G10H 2210/321
See application file for complete search history.

(56) References Cited

U.S. PATENT DOCUMENTS 6,111,960 A 8/2000 Aarts et al.
6,229,135 B1 5/2001 Chen et al.

FOREIGN PATENT DOCUMENTS

GB 2443291 A 4/2008

*Primary Examiner* — James K Mooney
(74) *Attorney, Agent, or Firm* — Rimon, P.C.

(57) ABSTRACT

Apparatus for processing an audio signal including an audio processing device configured to process, evaluate and modify an audio signal.

16 Claims, 8 Drawing Sheets

APPARATUS FOR GENERATING AUDIO SIGNAL TO COMPENSATE FOR MISSING COMPONENTS IN THE AUDIO SIGNAL

CROSS-REFERENCE TO RELATED APPLICATIONS

This application claims priority to Patent Cooperation Treaty application serial number PCT/EP2019/078553, filed Oct. 21, 2019, the contents of which is incorporated herein by reference in its entirety.

The invention refers to an apparatus for processing an audio signal comprising a number of samples, particularly so as to generate missing harmonics of low-frequency components in the audio signal.

The processing of audio signals, i.e. particularly the processing of audio signals by reproducing audio signals, over audio output devices, such as mobile electronic devices, mobile loudspeakers, etc., having poor low-frequency response due to constructive and/or physical limits is a known challenge in the field audio signal processing.

In view of this challenge, known non-linear audio signal processing devices, e.g. known as "Maxxbass" or "Dirac Bass", allow for bass enhancement (essentially) based on non-linear distortion. Respective audio signal processing devices typically, comprise weighting an audio signal comprising a number of samples with a non-linear characteristic sample by sample. Respective audio signal processing devices typically, implement a "horizontal distortion" of the audio signal by modifying the amplitude of the samples.

Thereby, the level of generated harmonics and thus, the magnitude of the acoustically perceivable virtual bass enhancement is highly dependent on the audio signal level. Further, resulting harmonic instabilities need to be mitigated by determining loudness estimations and applying automatic gain control stages (AGC-stages) which oftentimes introduce further difficulties.

As a result, there exists a need for an improved approach for processing an audio signal comprising a number of samples, particularly so as to generate missing harmonics of low-frequency components in the audio signal.

It is the object of the invention to provide an improved apparatus for processing an audio signal comprising a number of samples, particularly so as to generate harmonics, particularly missing harmonics, of low-frequency components in the audio signal.

This object is achieved by an apparatus for processing an audio signal comprising a number of samples, particularly so as to generate harmonics of low-frequency components in the audio signal according to Claim 1. The Claims depending on Claim 1 refer to possible embodiments of the apparatus according to Claim 1.

A first aspect of the invention refers to an apparatus for processing an audio signal comprising a number of samples, particularly so as to generate harmonics of low-frequency components in the audio signal.

The apparatus may generally, be applied in a wide range of audio applications. The apparatus may generally, be applied in any audio application where, e.g. due to constructive and/or physical limitations of audio output elements, e.g. loudspeakers, a poor low frequency response is given. In other words, the apparatus may generally, be applied in any audio application in which, due to constructive and/or physical limitations of audio output elements, e.g. loudspeakers, a virtual bass enhancement is of use for compensating missing harmonics of low-frequency components, which may also be deemed or denoted as bass components, in an audio signal.

An exemplary audio application of the apparatus is a mobile device application or a portable device application. As such, the apparatus may be installed in a mobile device or in a portable device, e.g. a mobile computer, a smartphone, a tablet, a mobile loudspeaker, etc.

A preferred audio application of the apparatus is an automotive audio application. As such, the apparatus may be installed in a vehicle or car, respectively. The apparatus may thus, be provided as a vehicle audio system or a car audio system, respectively or the apparatus may form part of a vehicle audio system or a car audio system, respectively. In an automotive application, the apparatus may allow for compensating missing harmonics of low-frequency components of an audio signal resulting from constructive and/or physical limitations of audio output elements, e.g. loudspeakers, provided in a vehicle or car, respectively.

Irrespective of its application, the apparatus may be embodied in hardware and/or in software.

The apparatus comprises at least one hardware- and/or software embodied audio processing device.

The at least one audio processing device is configured to process an input audio signal comprising a number of samples in a time-dependent representation of the input audio signal, particularly in a half-wave representation of the input audio signal. The time-dependent representation of the input audio signal typically, is or comprises a time-dependent representation of spaced sampling points of the input audio signal, more particularly a time-dependent representation of non-uniformly spaced sampling points of the input audio signal. The time-dependent representation of the input audio signal may comprise a graph function (curve) interconnecting the sample points of the input audio signal along a time axis, i.e. typically an x-axis representing the samples of the input audio signal, or a representation of a respective graph function (curve) interconnecting the sample points of the input audio signal along a time axis, i.e. typically an x-axis representing the samples of the input audio signal. A respective graph function may be determined by interpolation of the sample points of the input audio signal, for instance. The audio processing device is thus, configured to generate a time-dependent representation of an input audio signal, particularly a half-wave representation of an input audio signal, from an input audio signal comprising a number of samples. During operation of the apparatus, the audio processing device thus, processes a respective input audio signal in a time-dependent representation of the input audio signal, particularly in a half-wave representation of the input audio signal. During operation of the apparatus, the audio processing device thus, generates a time-dependent representation of the input audio signal, particularly a half-wave representation of the input audio signal, from a respective input audio signal.

The audio processing device is further configured to determine an interval between a first zero-crossing and a further zero-crossing of the input audio signal in the time-dependent representation of the input audio signal. The audio processing device is thus, configured to analyze the time-dependent representation of the input audio signal for zero-crossings, i.e. locations at which a respective graph function interconnecting the sample points of the input audio signal in the time-dependent representation crosses a time axis and, based on the determination of respective zero-crossings, determine an interval between a first zero-crossing, i.e. a first location at which a respective graph function interconnecting the sample points of the input audio signal in the time-dependent representation crosses the time-axis for a first time, and a further zero-crossing (or second zero-crossing), i.e. a further location at which a respective graph function interconnecting the sample points of the input audio signal in the time-dependent representation crosses the time-axis for a further time (or second time). During operation of the apparatus, the audio processing device thus, analyzes the time-dependent representation of the input audio signal for respective zero-crossings, i.e. locations at which a respective graph function interconnecting the sample points of the input audio signal in the time-dependent representation of the input audio signal crosses a time axis, and, based on the determination of respective zero-crossings, determines an interval between a respective first zero-crossing and a respective further zero-crossing (or second zero-crossing).

Respective first zero-crossings and further zero-crossing can be direct consecutive zero-crossings. However, it is also possible that respective first zero-crossings and further zero-crossing are not direct consecutive zero-crossings, but indirect consecutive zero-crossings such that at least one zero-crossing lies in between a respective first zero-crossing and a respective further zero-crossing. As such, a respective interval may extend between two directly consecutive zero-crossings of the time-dependent representation of an input audio signal or a respective interval extend between two indirectly consecutive zero-crossings of the time-dependent representation of an input audio signal.

The at least one audio processing device is further configured to determine a first set of sample points in the determined interval, the first set of sample points comprising a number of sample points at first positions in the interval. During operation of the apparatus, the audio processing device thus, determines a first set of sample points in the interval, the first set of sample points comprising a number of sample points at first positions in the interval. The positions of the sample points of the first set of sample points in the interval typically, represent the original positions of the sample points of the input audio signal in the interval as given in the time-dependent representation of the input audio signal. In other words, the positions of the sample points of the first set of sample points typically, corresponds to the original positions of the sample points of the input audio signal in the interval as given in the time-dependent representation of the input audio signal obtained by processing the input audio signal.

The at least one audio processing device is further configured to determine a second set of sample points in the determined interval, the second set of sample points comprising a number of sample points at second positions in the interval. During operation of the apparatus, the at least one audio processing device thus, determines a second set of sample points in the interval, the second set of sample points comprising a number of sample points at second positions in the interval. The positions of the sample points of the second set of sample points typically, represent target positions of the sample points of the input audio signal in the interval and thus, are offset from the original positions of the sample points of the input audio signal in the interval as given in the time-dependent representation of the input audio signal. In other words, the positions of the sample points P of the second set of sample points in the interval typically, corresponds to positions offset from the positions of the sample points of the first set of sample points in the interval as given in the time-dependent representation of the input audio signal.

The number of sample points of the first set of sample points typically, equals the number of sample points of the second set of sample points.

The at least one audio processing device is further configured to modify the input audio signal in the interval, on basis of an audio signal modification rule, by changing positions of the sample points of the first set of sample points in the interval such that each sample point of the first set of sample points is changed from its respective first position in the first set of sample points to its respective second position in the second set of sample points. During operation of the apparatus, the at least one audio processing device thus, changes the positions of the sample points of the first set of sample points in the interval such that each sample point of the first set of sample points is changed from its respective first position in the first set of sample points to its respective second position in the second set of sample points on basis of an audio signal modification rule, i.e. using an audio signal modification rule. The audio signal modification rule may thus, specify the change of positions of sample points in the interval such that the position of each sample point is changed from its initial position in the first set of sample points to its target position in the second set of sample points. The modification rule may thus, also specify an offset between the position of a respective sample point in the first set of sample points, i.e. before the position of a respective sample point has been changed, and the changed position of the respective sample point in the second set of sample points, i.e. after the position of the respective sample point has been changed.

The at least one audio processing device is further configured to apply the modified audio signal interval to the respective interval of the original input audio signal so as to generate a modified audio signal. During operation of the apparatus, the at least one audio processing device thus, applies the modified audio signal interval to the respective interval of the original input audio signal so as to generate a modified audio signal. The modified audio signal is acoustically perceivable or perceived as if the original input audio signal would comprise the generated harmonics of low-frequency components. The modified audio signal is typically, invariant to the level of the input audio signal such that there is no need to apply automatic gain control stages.

The modified audio signal may be output in an acoustic environment, e.g. a vehicle cabin, via an audio output device comprising one or more audio output elements, such as loudspeakers.

The audio processing device may be provided with computer-readable instructions that, when executed by a processing unit of the audio processing device enable the audio processing device to implement the above processing, determining, modifying and applying aspects specified above.

The apparatus allows for a highly efficient principle of generating harmonics of low-frequency components of an input audio signal with relatively low complexity thus, making it suitable for real-time applications.

As is apparent from the above description of the operation of the at least one audio processing device, the at least one audio processing device is thus, configured to re-sample an input audio signal having a number samples, particularly on a non-uniformly spaced basis, and, particularly on a uniformly spaced basis, spread the samples out again by changing of the positions of the sample points of the first set of sample points such that each sample point of the first set of sample points is changed from its respective first position in the first set of sample points to its respective second position in a second set of sample points.

Merely as an example, an input audio signal representing a positive pure sine half-wave is re-sampled with a low sample point density at the beginning of the half-wave and an increasingly higher sample point density towards the end of the half-wave may result in a waveform of the audio signal that resembles a falling sawtooth. If the following negative half-wave is re-sampled with inverse sample point density, a resulting audio signal will have the same fundamental frequency as the original sine half-wave but with a harmonic pattern similar to a sawtooth half-wave.

The at least one audio processing device may be configured to determine the number of sample points between the first zero-crossing and the at least one further zero-crossing such that is identical to the number of sample points in the respective interval in the original input audio signal. Determining the number of sample points between the first zero-crossing and the at least one further zero-crossing such that is identical to the number of sample points in the respective interval in the original input audio signal typically, positively affects the generation of harmonics of low-frequency components.

The at least one audio processing device may be configured to modify the audio signal on basis of an audio signal modification rule specifying a definable or defined change of positions of the sample points of the first set of sample points in the interval such that each sample point of the first set of sample points is changed from its respective first position in the first set of sample points to its respective second position in the second set of sample points.

The audio signal modification rule may particularly specify a defined change of positions of the sample points of the first set of sample points in the interval such that each sample point of the first set of sample points is changed from its respective first position in the first set of sample points to its respective second position in the second set of sample points such that the sample points of the second set of sample points are equally or uniformly spaced. The audio processing device may thus, be configured to equally or uniformly spread the samples out again by changing of the positions of the sample points of the first set of sample points such that each sample point of the first set of sample points is changed from its respective first position in the first set of sample points to its respective second position in the second set of sample points with the premise of equally or uniformly spaced positions of the sample points in the second set of sample points.

The audio signal modification rule may be or may comprise a mapping function, particularly a monotonic mapping function, configured to map input sample points of the first set of sample points having a respective first position to output sample points of the second set of sample points having a respective second position. The mapping function may specifically, map input sample points in a pre-definable or pre-defined range, e.g. in a range of [0, 1], to output sample points in the pre-definable or pre-defined range. Hence, the at least one audio processing device may be configured to map positions of each sample point in the first set of sample points to a defined position in the second set of sample points on basis of a respective mapping function. The mapping function may specifically allow for uniform spaced positions of the sample points in the second set of sample points. The mapping function allows for concertedly affecting the acoustically perceivable properties of the modified audio signal.

Additionally or alternatively, the audio signal modification rule may be or may comprise a tilting function, configured to tilt a zero-crossing tangent of the input audio signal in clockwise or counter-clockwise direction. Hence, the at least one audio processing device may be configured to tilt a zero-crossing tangent, i.e. a tangent of a respective graph function (curve) interconnecting the sample points of the input audio signal along a time axis, i.e. typically an x-axis representing the samples of the input audio signal, or a representation of a respective graph function (curve) interconnecting the sample points of the input audio signal along a time axis, i.e. typically an x-axis representing the samples of the input audio signal, in a respective zero-crossing, of the input audio signal by a pre-definable or pre-defined degree in clockwise direction or in counter-clockwise direction. The tilting function thus, allows for concertedly affecting the acoustically perceivable properties of the modified audio signal.

Typically, an input audio signal processable or processed by the at least one audio processing device has a specific original waveform. The at least one audio processing device may be configured to modify the specific original waveform of the input audio signal to at least one target waveform of the modified audio signal. Particularly, the at least one audio processing device may be configured to modify the specific original waveform of the input audio signal on basis of the or an audio signal modification rule specifying a defined change of the waveform of the input audio signal from its original waveform to at least one target waveform of the modified audio signal. The at least one audio processing device may thus, be configured to modify the original waveform of the input audio signal by applying at least one respective audio signal modification rule. The modification of the original waveform of an input audio signal to a target waveform of a modified audio signal or towards a target waveform of a modified audio signal thus, allows for concertedly affecting the acoustically perceivable properties of the modified audio signal.

A respective target waveform of the input audio signal may be a symmetric waveform, particularly a rectangular-waveform, a triangle-waveform or a needle-waveform. Alternatively, a respective target waveform of the input audio signal may be an asymmetric waveform, particularly a sawtooth-waveform, preferably a straight or dented falling or rising sawtooth-waveform. However, a respective target waveform may also be a freeform waveform.

The at least one audio processing device may be configured to apply a skipping rule or a skipping factor according to which at least one zero-crossing between a first zero-crossing and a further zero-crossing is not considered for determining the interval between the first zero-crossing and the further zero-crossing of the audio signal. The application of a respective skipping rule or a respective skipping factor may allow for generating modified audio signal with very low frequencies. As a general rule, the higher the skipping a factor the lower the frequencies of the modified audio signal. The application of a respective skipping rule or a respective skipping factor thus, allows for concertedly affecting the acoustically perceivable properties of the modified audio signal.

The apparatus may further comprise at least one filter device, particularly a lowpass filter device, arranged and/or configured to apply at least one filtering rule on the audio signal before the audio signal is processed by the audio processing device. A respective filter device is typically, arranged on an input side of the audio processing device. Additionally or alternatively, the apparatus may further comprise at least one filter device, particularly a lowpass filter device, arranged to apply at least one filtering rule on the audio signal after the audio signal was processed by the audio processing device. A respective filter device is typically, arranged on an output side of the audio processing device. Respective filter devices typically, e.g. due to the ability to remove undesired intermodulation artifacts, positively affect the generation of respective harmonics of low-frequency components in an input audio signal. The cut-off frequency of a respective filter device may be determined on basis of operational parameters of the apparatus. Merely as an example, the cut-off frequency of a respective filter device may be the lower −3 dB cutoff frequency of the apparatus.

The apparatus may comprise one or more audio processing devices. The provision of a plurality of audio processing devices allows for processing more than one half-wave of an input audio signal at once thereby, generating (sub)harmonic low-frequency components.

As such, the apparatus may comprise a first audio processing device and at least one further audio processing device.

A respective first audio processing device may be arranged in parallel to a respective at least one further audio processing device and vice versa. Hence, the apparatus may comprise a first audio processing device and at least one further audio processing device arranged in a parallel arrangement.

A respective first audio processing device may be configured to modify an input audio signal on basis of a first audio signal modification rule, by changing positions of the sample points of the first set of sample points in the interval such that each sample point of the first set of sample points is changed from its respective first position in the first set of sample points to its respective second position in the second set of sample points. A respective at least one further audio processing device may be configured to modify the input audio signal on basis of at least one further audio signal modification rule, by changing positions of the sample points of the first set of sample points in the interval such that each sample point of the first set of sample points is changed from its respective first position in the first set of sample points to its respective second position in the second set of sample points. Hence, the audio signal modification properties of a respective first audio processing device and a respective at least one further audio processing device may at least partly differ; typically, the possibilities of generating harmonics of low-frequency components of an input audio signal can be enhanced by using two or more audio processing devices.

As such, the first audio signal modification rule of a respective first audio processing device may specify a defined change of the waveform of the audio signal from its original waveform to at least one first target waveform of the audio signal, and the at least one further audio signal modification rule of a respective at least one further audio processing device may specify a defined change of the waveform of the audio signal from its original waveform to at least one further target waveform of the audio signal. Thereby, the first target waveform of the audio signal as specified by the at least one first audio signal modification rule may be opposite to the at least one further target waveform of the audio signal as specified by the at least one further audio signal modification rule. Merely as an example for an asymmetric target waveform, a first target waveform of the audio signal may be a rising sawtooth-waveform and at least one further target waveform of the audio signal may be a falling sawtooth-waveform. Analogous principles apply for other asymmetric waveforms. Analogous principles also apply for symmetric waveforms.

A respective first audio processing device may be configured to apply a first skipping rule or a first skipping factor according to which at least one zero-crossing between a first zero-crossing and a further zero-crossing is not considered for determining the interval between the first zero-crossing and the further zero-crossing of the audio signal, and a respective at least one further audio processing device may be configured to apply at least one further skipping rule or at least one further skipping factor according to which at least one zero-crossing between a first zero-crossing and a further zero-crossing is not considered for determining the interval between the first zero-crossing and the further zero-crossing of the audio signal. Thereby, the first skipping rule or first skipping factor as applicable by the at least one first audio processing device may be different, i.e. higher or lower, to the at least one further skipping rule or at least one further skipping factor as applicable by the at least one further audio processing device. Applying different skipping rules or skipping factors, respectively allows for concertedly affecting the acoustically perceivable properties of the modified audio signal.

A second aspect of the invention refers to an apparatus for outputting an audio signal, particularly in a vehicle cabin, the audio signal comprising a number of samples, particularly so as to generate missing low-frequency components in the audio signal. The apparatus comprises:

at least one audio processing device configured to:

process an audio signal comprising a number of non-uniformly spaced sampling points in a time-dependent representation of the audio signal, particularly in a half-wave representation of the audio signal;

determine an interval between a first zero-crossing and a further zero-crossing of the audio signal;

determine a first set of sample points in the interval, the first set of sample points comprising a number of sample points at first positions in the interval;

determine a second set of sample points in the interval, the second set of sample points comprising a number of sample points at second positions in the interval;

modify the audio signal in the interval, on basis of an audio signal modification rule, by changing positions of the sample points of the first set of sample points in the interval such that each sample point of the first set of sample points is changed from its respective first position in the first set of sample points to its respective second position in the second set of sample points;

apply the modified audio signal interval to the respective interval of the original audio signal so as to generate a modified audio signal; and at least one audio output device being configured to output the modified audio signal in an acoustic environment, particularly in a vehicle cabin.

The at least one audio output device comprises one or more audio output elements, such as loudspeakers. At least one audio output element may be built as a specific bass audio output element, such as a bass loudspeaker or a bass shaker.

The apparatus may particularly comprise an audio processing device as specified in accordance with the apparatus according to the first aspect of the invention.

All annotations regarding the apparatus according to the first aspect of the invention also apply to the apparatus of the second aspect of the invention.

A third aspect of the invention refers to a method for processing an audio signal comprising a number of samples, particularly so as to generate missing low-frequency components in the audio signal. The method comprises:

processing an audio signal comprising a number of non-uniformly spaced sampling points in a time-dependent representation of the audio signal, particularly in a half-wave representation of the audio signal;

determining an interval between a first zero-crossing and a further zero-crossing of the audio signal;

determining a first set of sample points in the interval, the first set of sample points comprising a number of sample points at first positions in the interval;

determining a second set of sample points in the interval, the second set of sample points comprising a number of sample points at second positions in the interval;

modifying the audio signal in the interval, on basis of an audio signal modification rule, by changing positions of the sample points of the first set of sample points in the interval such that each sample point of the first set of sample points is changed from its respective first position in the first set of sample points to its respective second position in the second set of sample points;

applying the modified audio signal interval to the respective interval of the original audio signal so as to generate a modified audio signal.

All annotations regarding the apparatus according to the first aspect of the invention also apply to the method of the third aspect of the invention.

A fourth aspect of the invention refers to a method for outputting an audio signal, particularly in a vehicle cabin, the audio signal comprising a number of samples, particularly so as to generate missing low-frequency components in the audio signal. The method comprises:

processing an audio signal comprising a number of non-uniformly spaced sampling points in a time-dependent representation of the audio signal, particularly in a half-wave representation of the audio signal;

determining an interval between a first zero-crossing and a further zero-crossing of the audio signal;

determining a first set of sample points in the interval, the first set of sample points comprising a number of sample points at first positions in the interval;

determining a second set of sample points in the interval, the second set of sample points comprising a number of sample points at second positions in the interval;

modifying the audio signal in the interval, on basis of an audio signal modification rule, by changing positions of the sample points of the first set of sample points in the interval such that each sample point of the first set of sample points is changed from its respective first position in the first set of sample points to its respective second position in the second set of sample points;

applying the modified audio signal interval to the respective interval of the original audio signal so as to generate a modified audio signal; and outputting the modified audio signal, particularly in a vehicle cabin.

All annotations regarding the apparatus according to the second aspect of the invention also apply to the method of the fourth aspect of the invention.

Exemplary embodiments of the invention are described with reference to the Fig., whereby:

FIG. 1-5 each shows a principle drawing of an apparatus according to an exemplary embodiment;

The apparatus 1 comprises an audio input device 2, i.e. a device through which a digital input audio signal can be input to the apparatus 1, and an audio outputting device 3, i.e. a device through which a modified audio signal can be output in an acoustic environment. The audio input device 2 may comprise one or more audio input elements, e.g. digital audio input interfaces. The audio output device 3 may comprise one or more audio output elements, such as loudspeakers.

The apparatus 1 may generally, be applied in any audio application where, e.g. due to constructive and/or physical limitations of audio output elements, e.g. loudspeakers, a poor low frequency response is given. In other words, the apparatus 1 may generally, be applied in any audio application in which, due to constructive and/or physical limitations of audio output elements, e.g. loudspeakers, a virtual bass enhancement is of use for compensating missing harmonics of low-frequency components in an audio signal.

An exemplary audio application of the apparatus 1 is a mobile device application or a portable device application. As such, the apparatus 1 may be installed in a mobile device or in a portable device, e.g. a mobile computer, a smartphone, a tablet, a mobile loudspeaker, etc.

Figure 1:
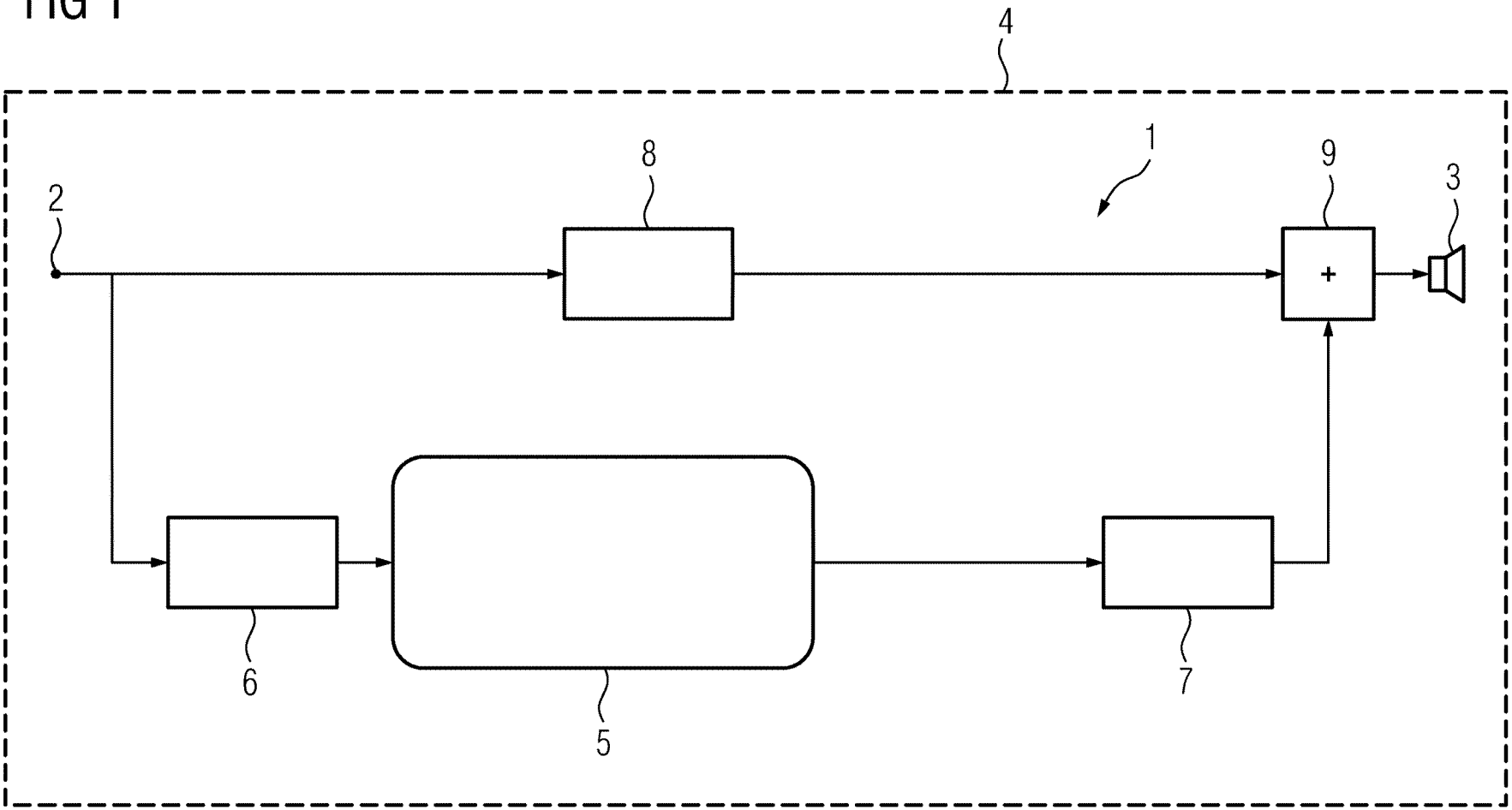
FIG. 1 shows a principle drawing of an apparatus 1 for processing an audio signal comprising a number of samples according to an exemplary embodiment. The apparatus 1 is specifically configured for processing an audio signal so as to generate (missing) harmonics of low-frequency components of an input audio signal.

FIG. 1 exemplarily shows an automotive audio application of the apparatus 1. As such, the apparatus 1 may be installed in a vehicle 4 or car, respectively. The apparatus 1 may be provided as a vehicle audio system or a car audio system, respectively or the apparatus 1 may form part of a vehicle audio system or a car audio system, respectively. In the automotive application of FIG. 1, the apparatus 1 may allow for compensating missing harmonics of low-frequency components of an audio signal resulting from constructive and/or physical limitations of audio output elements, e.g. loudspeakers, provided in the vehicle 4 or car, respectively.

In the exemplary embodiment of FIG. 1, the apparatus 1 comprises a hardware- and/or software embodied audio processing device 5, an optional first filter device 6 connected with the audio processing device 5 at an input side of the audio processing device 5, an optional second filter device 7 connected with the audio processing device 5 at an output side of the audio processing device 5, an optional compensation delay device 8 in a parallel arrangement to the audio processing device 5, and an optional mixer device 9 connected with the second filter device at an output side of the second filter device 7 and with the delay device 8 at an output side of the delay device 8.

Figure 6:
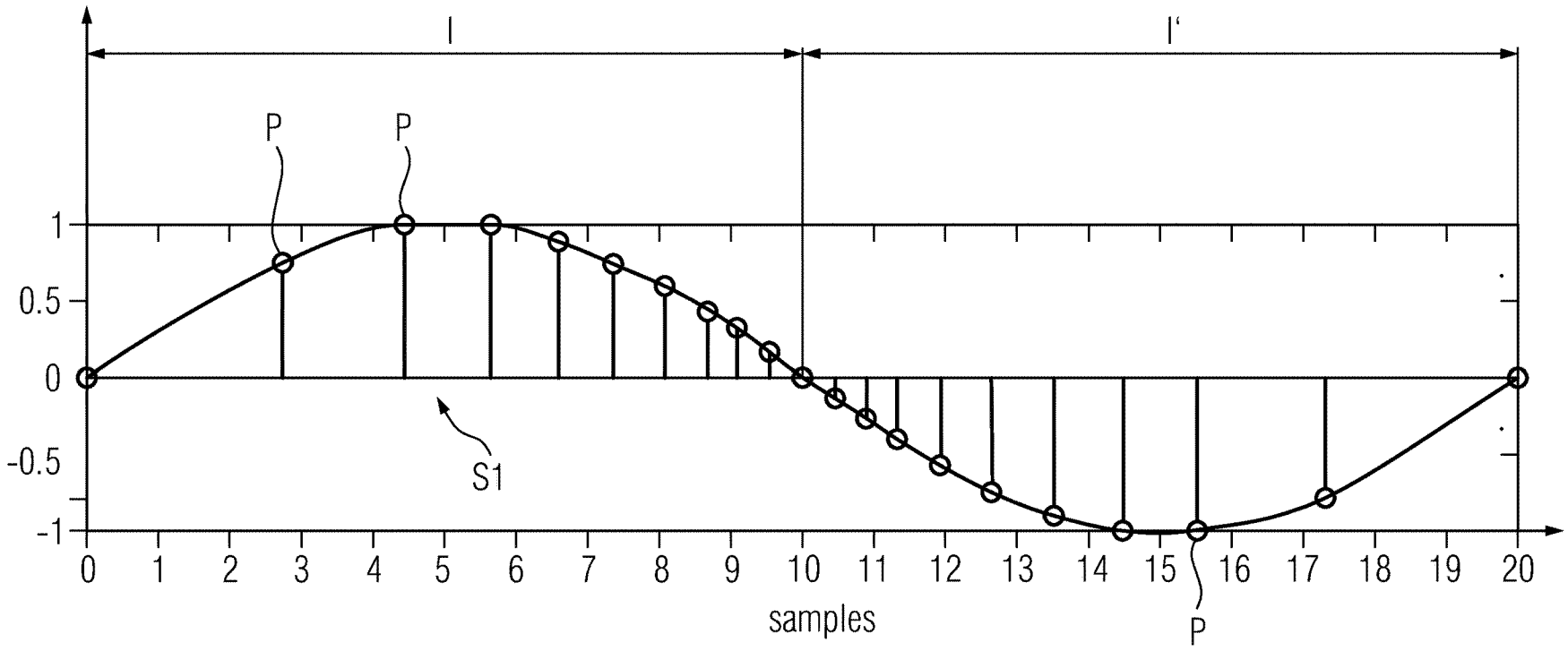
FIG. 6 shows a time-dependent representation of an input audio signal before modification on basis of an audio signal modification rule according to an exemplary embodiment.

The audio processing device 5 is configured to process an input audio signal comprising a number of samples in a time-dependent representation of the input audio signal, particularly in a half-wave representation of the input audio signal (see FIG. 6). As is apparent form FIG. 6, the time-dependent representation of the input audio signal is or comprises a time-dependent representation of spaced sampling points P1 of the input audio signal, more particularly a time-dependent representation of non-uniformly spaced sampling points P of the input audio signal. As is further apparent from FIG. 6, the time-dependent representation of the input audio signal may comprise a graph function (curve) interconnecting the sample points P of the input audio signal along a time axis, i.e. the x-axis representing the samples of the input audio signal. A respective graph function may be determined by interpolation of the sample points P of the input audio signal, for instance. The audio processing device 5 is thus, configured to generate a time-dependent representation of an input audio signal, particularly a half-wave representation of an input audio signal, from an input audio signal comprising a number of samples. During operation of the apparatus 1, the audio processing device 5 thus, processes a respective input audio signal in a time-dependent representation of the input audio signal, particularly in a half-wave representation of the input audio signal, and generates a time-dependent representation of the input audio signal, particularly a half-wave representation of the input audio signal, from a respective input audio signal.

The audio processing device 5 is further configured to determine an interval I between a first zero-crossing and a further zero-crossing of the input audio signal in the time-dependent representation of the input audio signal. The audio processing device 5 is thus, configured to analyze the time-dependent representation of the input audio signal for zero-crossings, i.e. locations at which the graph function interconnecting the sample points P of the input audio signal in the time-dependent representation crosses the time axis and, based on the determination of respective zero-crossings, determine an interval between a first zero-crossing, i.e. a first location at which the graph function interconnecting the sample points P of the input audio signal crosses the time-axis for a first time, and a further zero-crossing (or second zero-crossing), i.e. a further location at which the graph function interconnecting the sample points P of the input audio signal crosses the time-axis for a further time (or second time). During operation of the apparatus 1, the audio processing device 5 thus, analyzes the time-dependent representation of the input audio signal for respective zero-crossings and, based on the determination of respective zero-crossings, determines an interval I between a respective first zero-crossing and a respective further zero-crossing (or second zero-crossing).

Respective first zero-crossings and further zero-crossing can be direct consecutive zero-crossings. However, it is also possible that respective first zero-crossings and further zero-crossing are not direct consecutive zero-crossings, but indirect consecutive zero-crossings such that at least one zero-crossing lies in between a respective first zero-crossing and a respective further zero-crossing. As such, a respective interval I may extend between two directly consecutive zero-crossings of the time-dependent representation of an input audio signal or a respective interval I may extend between two indirectly consecutive zero-crossings of the time-dependent representation of an input audio signal.

The audio processing device 5 is further configured to determine a first set S1 of sample points P in the determined interval I, the first set of sample points P comprising a number of sample points P at first positions in the interval I (see FIG. 6). During operation of the apparatus 1, the audio processing device 5 thus, determines a first set S1 of sample points P in the interval I, the first set S1 of sample points P comprising a number of sample points P at first positions in the interval I (see FIG. 6). The positions of the sample points P of the first set S1 of sample points P in the interval I typically, represent the original positions of the sample points P of the input audio signal in the interval I as given in the time-dependent representation of the input audio signal (see FIG. 6). In other words, the positions of the sample points P of the first set S1 of sample points P typically, corresponds to the original positions of the sample points P of the input audio signal in the interval I as given in the time-dependent representation of the input audio signal obtained by processing the input audio signal.

Figure 7:
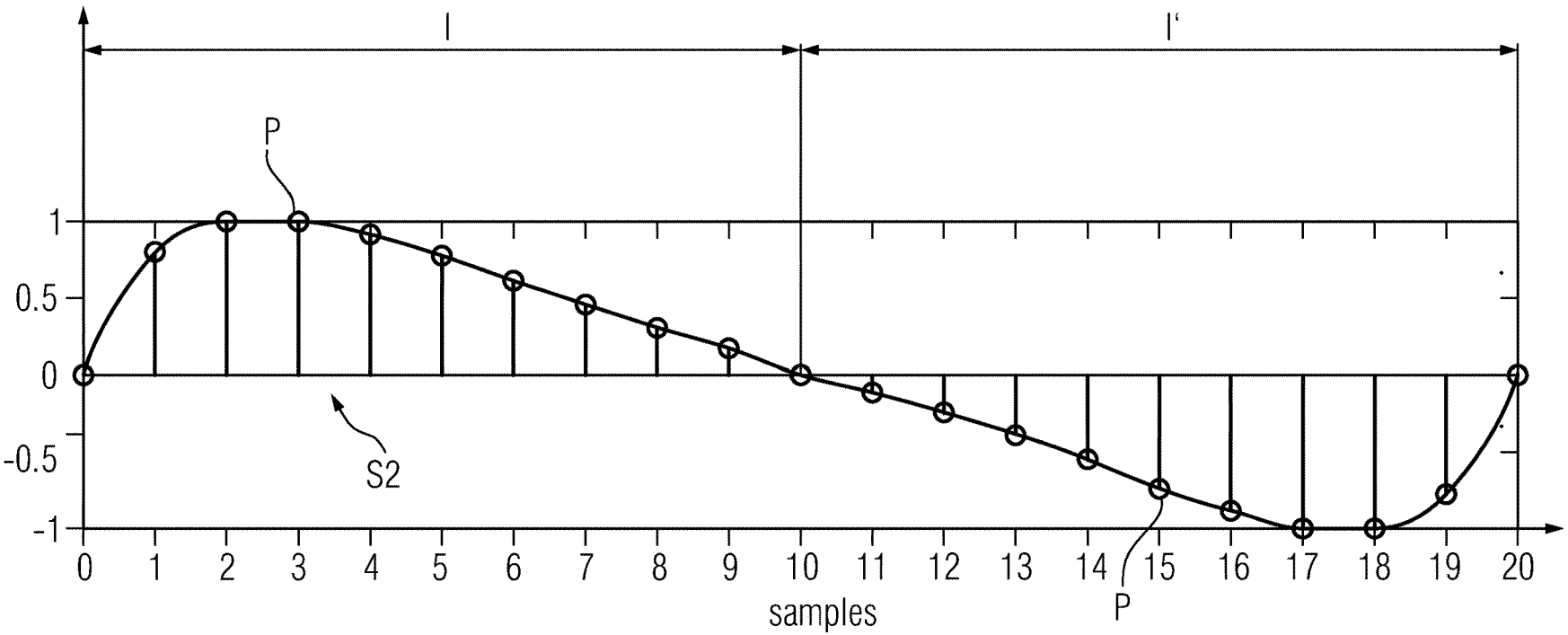
FIG. 7 shows a time-dependent representation of an input audio signal after modification on basis of an audio signal modification rule according to an exemplary embodiment.

The audio processing device 5 is further configured to determine a second set S2 of sample points in the determined interval I, the second set S2 of sample points P comprising a number of sample points P at second positions in the interval I (see FIG. 7). During operation of the apparatus 5, the audio processing device 5 thus, determines a second set S2 of sample points in the interval I, the second set S2 of sample points P comprising a number of sample points P at second positions in the interval I (see FIG. 7). The positions of the sample points P of the second set S2 of sample points P represent target positions of the sample points P of the input audio signal in the interval I and thus, are offset from the original positions of the sample points P of the input audio signal in the interval I as given in the time-dependent representation of the input audio signal (see FIGS. 6, 7). In other words, the positions of the sample points P of the second set S2 of sample points P in the interval I typically, corresponds to positions offset from the positions of the sample points P of the first set S1 of sample points P1 in the interval as given in the time-dependent representation of the input audio signal.

As is apparent from FIGS. 6, 7, the number of sample points P of the first set S1 of sample points P may equal the number of sample points P of the second set S2 of sample points P.

The audio processing device 5 is further configured to modify the input audio signal in the interval I, on basis of an audio signal modification rule, by changing positions of the sample points P of the first set S1 of sample points P in the interval I such that each sample point of the first set S1 of sample points P is changed from its respective first position in the first set S1 of sample points P as indicated in FIG. 6 to its respective second position in the second set S2 of sample points P as indicated in FIG. 7. During operation of the apparatus 1, the audio processing device 5 thus, changes the positions of the sample points P of the first set S1 of sample points P in the interval I and thus, such that each sample point P of the first set S1 of sample points P is changed from its respective first position in the first set S1 of sample points P as indicated in FIG. 6 to its respective second position in the second set S2 of sample points P as indicated in FIG. 7 on basis of an audio signal modification rule, i.e. using an audio signal modification rule. The audio signal modification rule may thus, specify the change of positions of sample points P in the interval I such that the position of each sample point P is changed from its initial position in the first set S1 of sample points (see FIG. 6) to its target position in the second set S2 of sample points (see FIG. 7). The modification rule may thus, also specify an offset between the position of a respective sample point P in the first set S1 of sample points P, i.e. before the position of a respective sample point P has been changed, and the changed position of the respective sample point P in the second set S2 of sample points P, i.e. after the position of the respective sample point P has been changed.

The audio processing device 5 is further configured to apply the modified audio signal interval I to the respective interval of the original input audio signal so as to generate a modified audio signal. The application of the modified audio signal to the respective interval of the original input audio signal may also be carried out through the mixer device 9. During operation of the apparatus 1, the audio processing device 5 thus, applies the modified audio signal interval to the respective interval of the original input audio signal so as to generate a modified audio signal. The modified audio signal is acoustically perceivable or perceived as if the original input audio signal would comprise the generated harmonics of low-frequency components. The modified audio signal is typically, invariant to the level of the input audio signal such that there is no need to apply automatic gain control stages.

The modified audio signal may be output in an acoustic environment, e.g. a vehicle cabin, via the audio output device 3.

As is apparent from the above description of the operation of the audio processing device 5, the audio processing device 5 is thus, configured to re-sample an input audio signal having a number samples, particularly on a non-uniformly spaced basis, and, particularly on a uniformly spaced basis, spread the samples out again by changing of the positions of the sample points P of the first set S1 of sample points P such that each sample point P of the first set S1 of sample points P is changed from its respective first position in the first set S1 of sample points P to its respective second position in the second set S2 of sample points P.

As is apparent from the exemplary embodiments of FIGS. 6, 7, an input audio signal representing a positive pure sine half-wave can be re-sampled with a low sample point density at the beginning of the half-wave and an increasingly higher sample point density towards the end of the half-wave which results in a waveform of the audio signal that resembles a falling sawtooth. As is further apparent from FIGS. 6, 7, if the following negative half-wave is re-sampled with inverse sample point density, a resulting audio signal will have the same fundamental frequency as the original sine half-wave but with a harmonic pattern similar to a sawtooth half-wave.

The audio processing device 5 may be configured to determine the number of sample points P between the first zero-crossing and the at least one further zero-crossing such that is identical to the number of sample points P in the respective interval I in the original input audio signal. Determining the number of sample points P between the first zero-crossing and the at least one further zero-crossing such that is identical to the number of sample points P in the respective interval I in the original input audio signal typically, positively affects the generation of harmonics of low-frequency components.

The audio processing device 5 may be configured to modify the audio signal on basis of an audio signal modification rule specifying a definable or defined change of positions of the sample points P of the first set S1 of sample points in the interval I such that each sample point P of the first set of sample points S1 is changed from its respective first position in the first set S1 of sample points P (see FIG. 6) to its respective second position S2 in the second set S2 of sample points P (see FIG. 7).

As is further apparent from FIGS. 6, 7, the audio signal modification rule may particularly specify a defined change of positions of the sample points P of the first set S1 of sample points P in the interval I such that each sample point P of the first set S1 of sample points P is changed from its respective first position in the first set S1 of sample points P (see FIG. 6) to its respective second position in the second set S2 of sample points P (see FIG. 7) such that the sample points P of the second set S2 of sample points P are equally or uniformly spaced. The audio processing device 5 may thus, be configured to equally or uniformly spread the samples out again by changing of the positions of the sample points P of the first set S1 of sample points P such that each sample point P of the first set S1 of sample points P is changed from its respective first position in the first set S1 of sample points P to its respective second position in the second set S2 of sample points P with the premise of equally or uniformly spaced positions of the sample points P in the second set S2 of sample points P.

The audio signal modification rule may be or may comprise a mapping function, particularly a monotonic mapping function, configured to map input sample points P of the first set S1 of sample points P1 having a respective first position to output sample points P of the second set S2 of sample points P having a respective second position. As is apparent from FIGS. 6, 7, the mapping function may specifically, map input sample points P (see FIG. 6) in a pre-definable or pre-defined range, e.g. in a range of [0, 1], to output sample points P (see FIG. 7) in the pre-definable or pre-defined range. Hence, the audio processing device 5 may be configured to map positions of each sample point P in the first set S1 of sample points P to a defined position in the second set S2 of sample points P on basis of a respective mapping function. As is apparent from FIGS. 6, 7, the mapping function may specifically allow for uniform spaced positions of the sample points P in the second set S2 of sample points P.

Three examples of a respective mapping function f(x) are given below with a resulting waveform shape of the modified audio signal in parentheses.

Example 1: $f(x)=(e^{x*D}-1)/(e^{D}-1)$ (rising dented sawtooth waveform)

Example 2: $f(x)=(e^{D}-e^{x_r*D})/(e^{D}-1)$ (falling dented sawtooth waveform)

Example 3: $f(x)=\log(1+(x*D))/\log(1+D)$ (falling straight sawtooth waveform)

Thereby, x can be a function of the sample points P of the second set S2 of sample points P, whereby $x(P)=P/(N-1)$, where N is the number of sample points P in the second set S2 of sample points P where P=0 for the first sample point in the respective set and P=N−1 for the last sample point P in the respective set. As such, x(P) lies in a range of [0, 1].

The above exemplary mapping functions f(x) are rising monotonously within in the range of [0, 1], include a pre-definable or pre-defined distortion parameter D, and may operate on a reversed input vector $x_r$, where $x_r(P)=x(N-1)-x(P)$.

Figure 8:
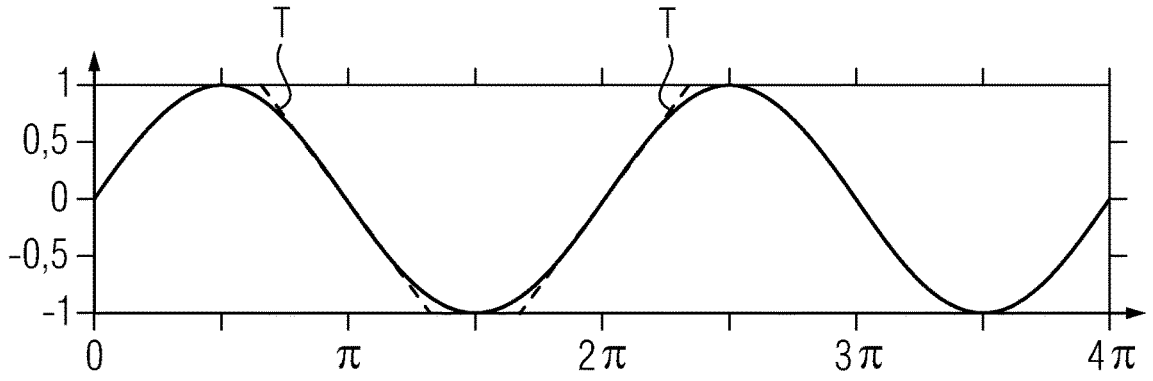
FIG. 8 shows a time-dependent representation of an input audio signal before modification on basis of an audio signal modification rule according to an exemplary embodiment.
Figure 9:
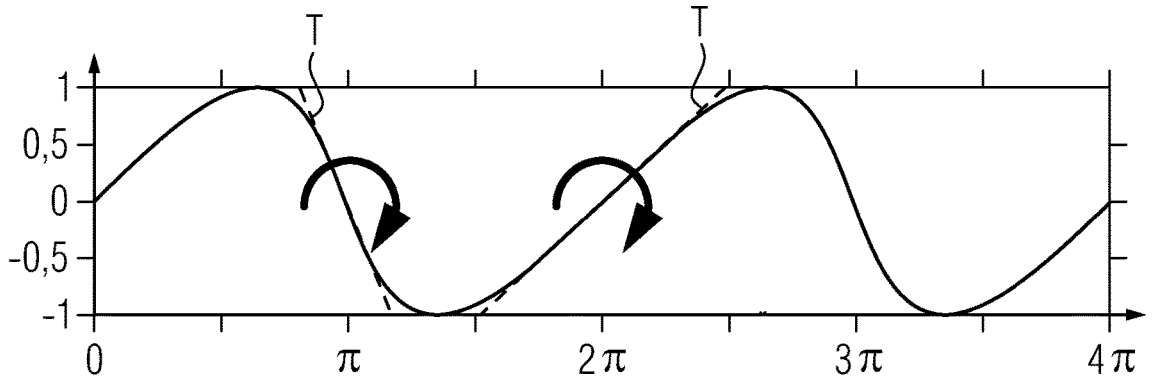
FIGS. 9, 10 each show a time-dependent representation of an input audio signal after modification on basis of an audio signal modification rule according to an exemplary embodiment.
Figure 10:
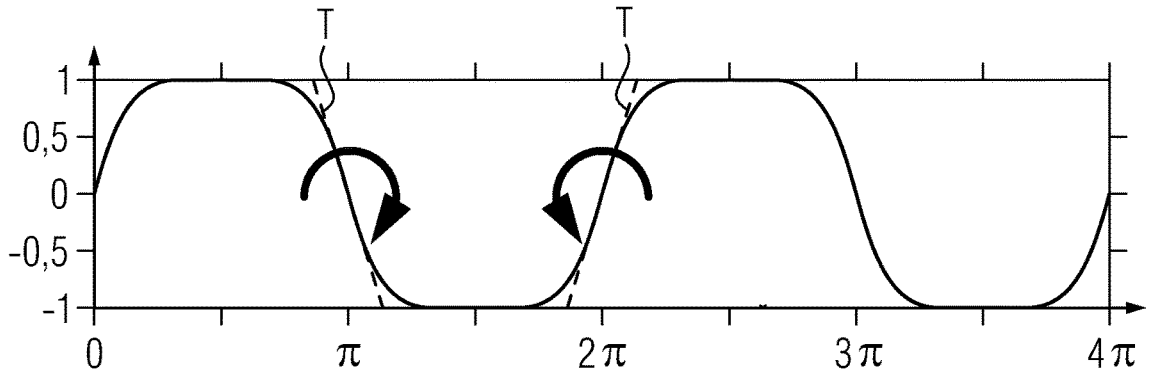

Additionally or alternatively, the audio signal modification rule may be or may comprise a tilting function, configured to tilt a zero-crossing tangent of the audio signal in clockwise or counter-clockwise direction (see FIG. 8-10). Hence, as indicated by the arrows in FIGS. 9, 10, the audio processing device 5 may be configured to tilt a zero-crossing tangent T, i.e. a tangent of a respective graph function (curve) interconnecting the sample points P of the input audio signal along a time axis, i.e. an x-axis representing the samples of the input audio signal in a respective zero-crossing, of the input audio signal by a pre-definable or pre-defined degree in clockwise direction (see FIG. 9) or in counter-clockwise direction (see FIG. 10).

As is apparent e.g. from FIG. 6-10, an input audio signal processable or processed by the audio processing device 5 has a specific original waveform. As is clear from the above description in context with FIG. 6-10, the audio processing device 5 is configured to modify the specific original waveform of the input audio signal to at least one target waveform of the modified audio signal. Particularly, the audio processing device 5 may be configured to modify the specific original waveform of the input audio signal on basis of an audio signal modification rule specifying a defined change of the waveform of the input audio signal from its original waveform to at least one target waveform of the modified audio signal. The audio processing device 5 may thus, be configured to modify the original waveform of the input audio signal by applying at least one respective audio signal modification rule.

A respective target waveform of the input audio signal may be a symmetric waveform (see FIG. 10), particularly a rectangular-waveform, a triangle-waveform or a needle-waveform. Alternatively, a respective target waveform of the input audio signal may be an asymmetric waveform (see FIG. 9), particularly a sawtooth-waveform, preferably a straight or dented falling or rising sawtooth-waveform. However, a respective target waveform may also be a freeform waveform.

The audio processing device 5 may be configured to apply a skipping rule or a skipping factor according to which at least one zero-crossing between a first zero-crossing and a further zero-crossing is not considered for determining the interval I between the first zero-crossing and the further zero-crossing of the audio signal. The application of a respective skipping rule or a respective skipping factor may allow for generating modified audio signal with very low frequencies. As a general rule, the higher the skipping a factor the lower the frequencies of the modified audio signal.

In the exemplary embodiments of FIG. 1, the optional first filter device 6 is embodied as a lowpass-filter, e.g. a lowpass-filter having a cutoff frequency of 100 Hz, and the optional second filter device 7, is embodied as a second lowpass-filter, e.g. a lowpass-filter having a cutoff frequency of 1000 Hz. However, other cutoff frequencies are conceivable.

Figure 2:
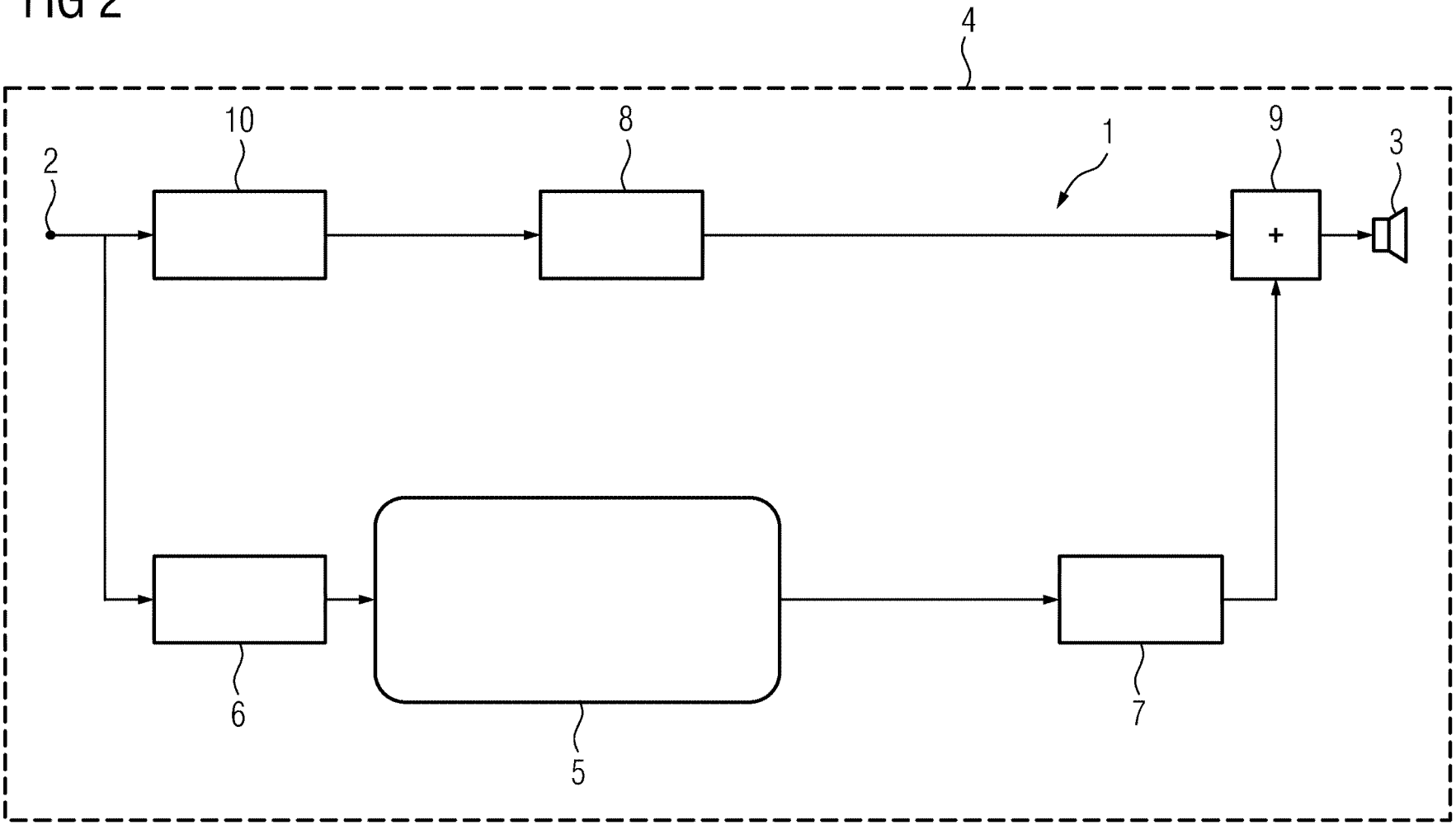

FIG. 2 shows a principle drawing of an apparatus 1 according to a further exemplary embodiment. The exemplary embodiment of the apparatus of FIG. 2 differs from the previous embodiments by an optional further filter device 10 connected with the delay device 8 at an input side of the delay device 8. The further filter device 10 can be embodied as a parametric EQ filter. The further filter device 10 may have a center frequency of 160 Hz. However, other center frequencies are conceivable.

Figure 3:
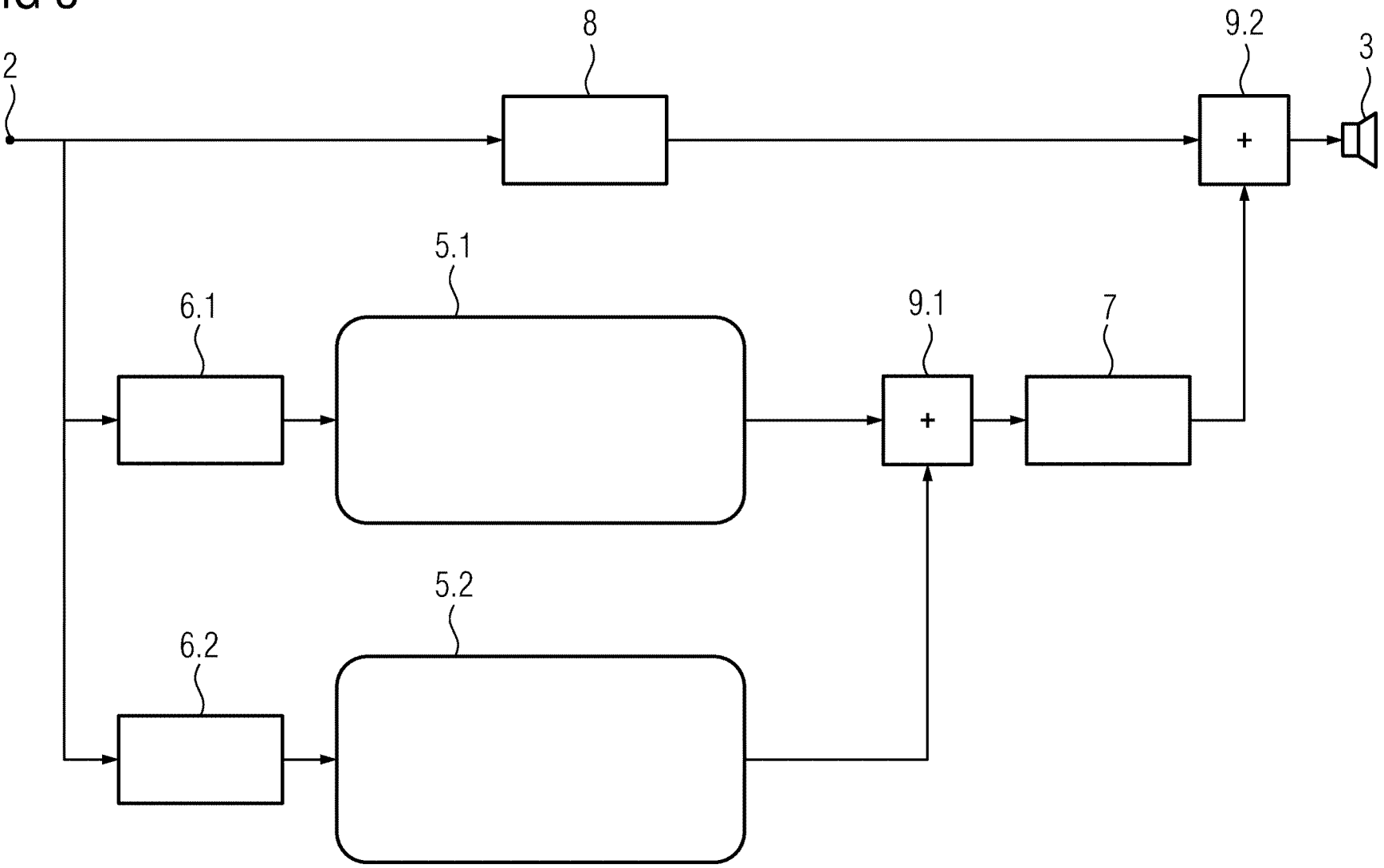
Figure 4:
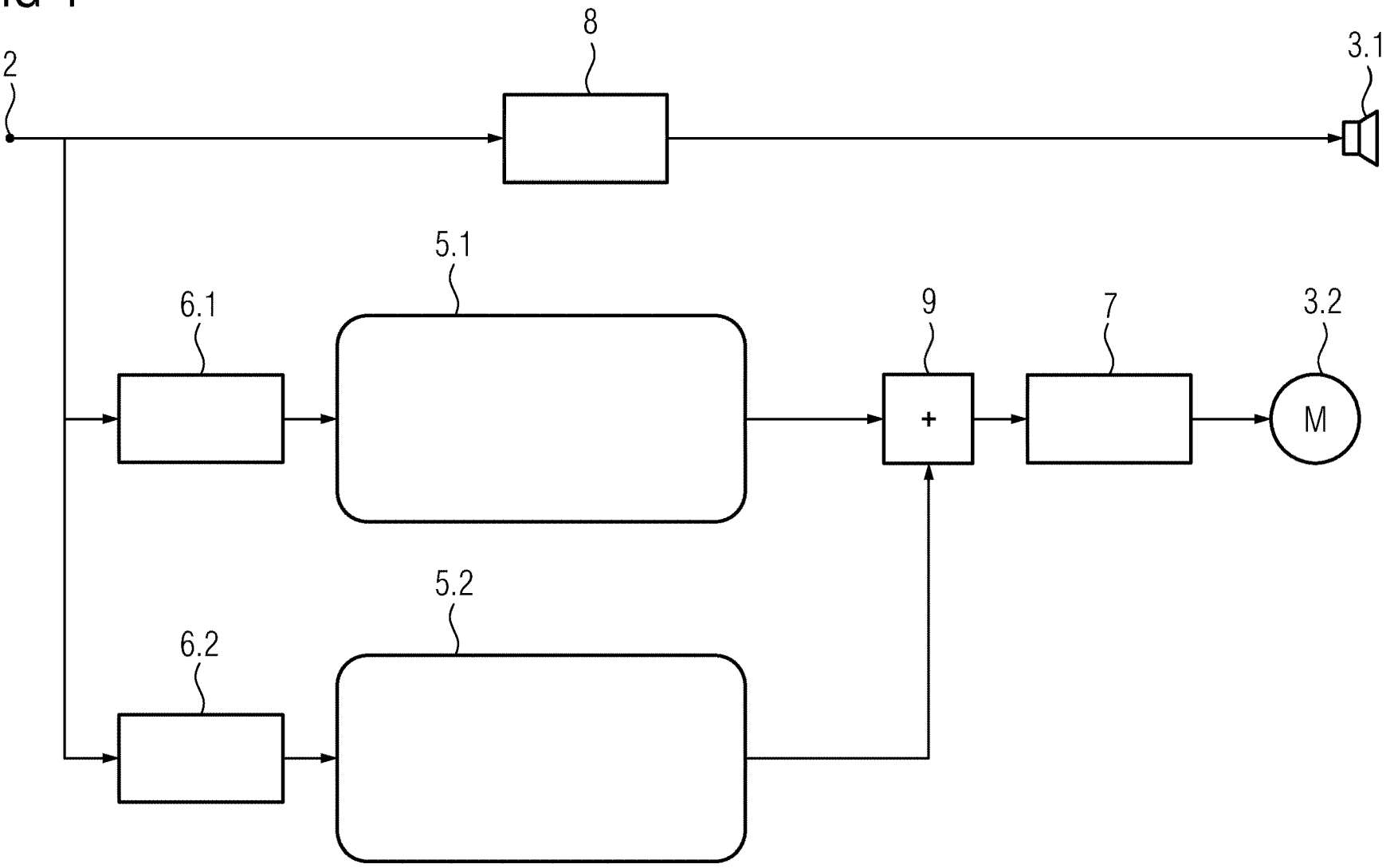
Figure 5:
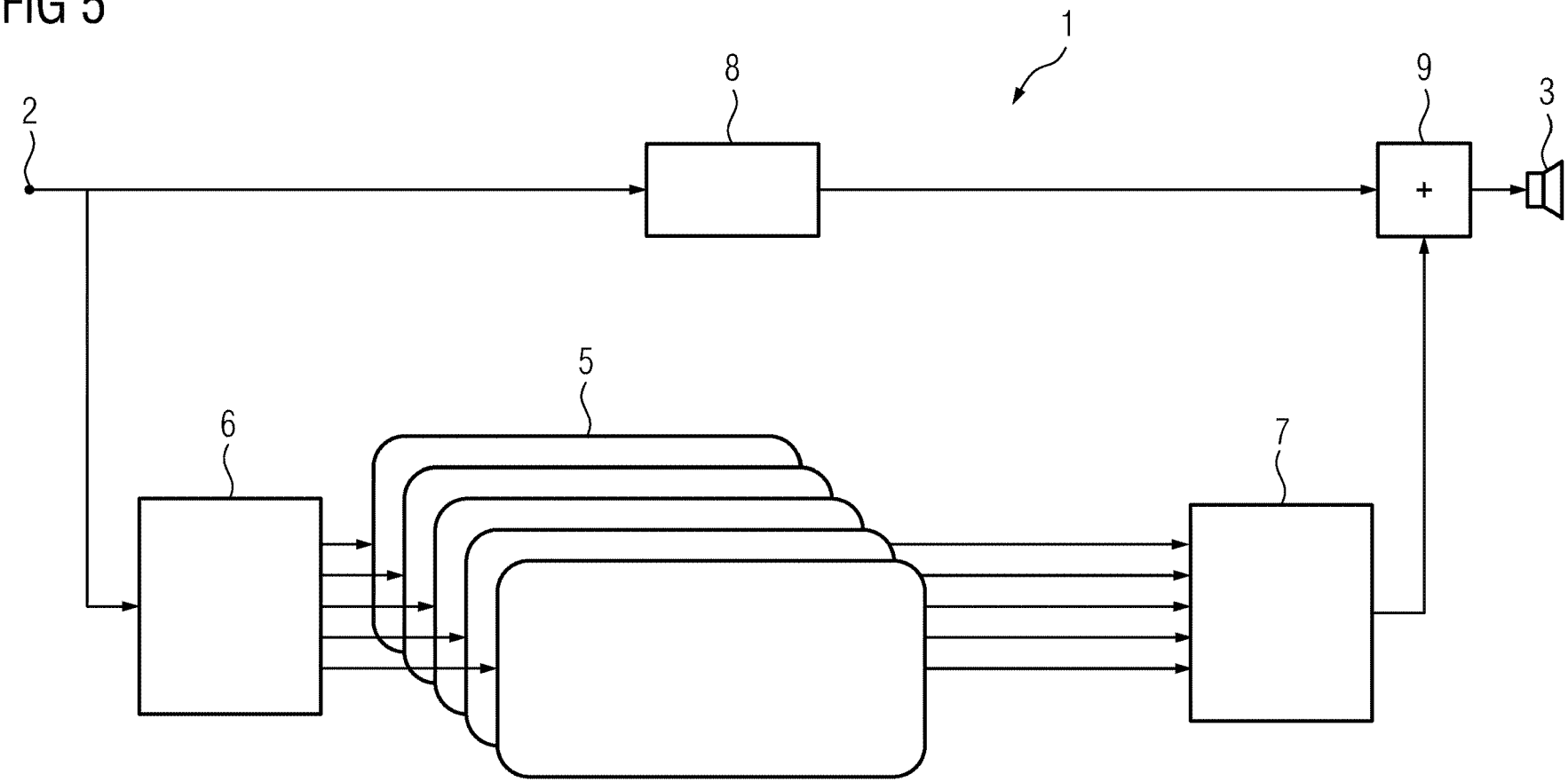

The exemplary embodiments of FIG. 3-5 each show an apparatus 1 comprising a plurality of audio processing devices 5 which allows for processing more than one half-wave of an input audio signal at once thereby, generating (sub)harmonic low-frequency components.

As is apparent from the embodiments of FIG. 3-5, the respective audio processing devices 5 may be arranged in a parallel arrangement.

FIG. 3 shows a principle drawing of an apparatus 1 comprising a plurality of audio processing devices 5 according to an exemplary embodiment. In this exemplary embodiment, a first audio processing device 5.1 (upper audio processing device 5) is configured to implement an audio signal modification rule modifying the original waveform of an input audio signal to at least one first target waveform of the modified audio signal, and the second audio processing device 5.2 (lower audio processing device 5) is configured to implement an audio signal modification rule modifying the original waveform of an input audio signal to at least one second target waveform of the modified audio signal. The first target waveform can be a rising straight sawtooth waveform, for instance. The second target waveform can be a falling straight sawtooth waveform, for instance.

FIG. 3 thus, shows that a first audio processing device 5.1 may be configured to modify an input audio signal on basis of a first audio signal modification rule, by changing positions of the sample points P of the first set S1 of sample points P in the interval I such that each sample point P of the first set S1 of sample points P is changed from its respective first position in the first set S1 of sample points P to its respective second position in the second set S2 of sample points P. A respective further audio processing device 5.2 may be configured to modify the input audio signal on basis of at least one further audio signal modification rule, by changing positions of the sample points P of the first set S1 of sample points P in the interval such that each sample point P of the first set of sample points P is changed from its respective first position in the first set S1 of sample points P to its respective second position in the second set S2 of sample points P. Hence, the audio signal modification properties of a first audio processing device 5.1 and a further audio processing device 5.2 may at least partly differ.

As such, the first audio signal modification rule of a respective first audio processing device may specify a defined change of the waveform of the audio signal from its original waveform to at least one first target waveform of the audio signal, and the at least one further audio signal modification rule of a respective at least one further audio processing device may specify a defined change of the waveform of the audio signal from its original waveform to at least one further target waveform of the audio signal. Thereby, the first target waveform of the audio signal as specified by the at least one first audio signal modification rule may be opposite to the at least one further target waveform of the audio signal as specified by the at least one further audio signal modification rule.

Further, a first audio processing device 5.1 may also be configured to apply a first skipping rule or a first skipping factor according to which at least one zero-crossing between a first zero-crossing and a further zero-crossing is not considered for determining the interval I between the first zero-crossing and the further zero-crossing of the audio signal, and a further audio processing device 5.2 may be configured to apply at least one further skipping rule or at least one further skipping factor according to which at least one zero-crossing between a first zero-crossing and a further zero-crossing is not considered for determining the interval I between the first zero-crossing and the further zero-crossing of the audio signal. Thereby, the first skipping rule or first skipping factor as applicable by the first audio processing 5.1 device may be equal or different, i.e. higher or lower, to the further skipping rule or a further skipping factor as applicable by further audio processing device 5.2. In the exemplary embodiment of FIG. 3, the skipping factors of the audio processing devices 5.1, 5.2 are equal. However, different skipping factors are conceivable.

FIG. 3 further shows a first optional filter 6.1 connected to the first audio processing device 5.1 at an input side of the first audio processing device 5.1 and a second optional filter 6.2 connected to the second audio processing device 5.2 at an input side of the second audio processing device 5.2. The optional filter devices 6.1, 6.2 can be embodied as lowpass filters. The optional filter devices 6.1, 6.2 can have the same or different cutoff frequencies. As an example, the first filter 6.1 can have a cutoff frequency of 100 Hz and the second filter 6.2 can have a cutoff frequency of 50 Hz. However, other cutoff frequencies are conceivable.

FIG. 3 further shows a further optional filter 7 connected with an optional first mixer device 9.1 at an output side of the first mixer device 9.1. The optional further filter device 7 can be embodied as lowpass filter. The optional further filter device 7 may have a cutoff frequency of 1000 Hz. However, other cutoff frequencies are conceivable.

FIG. 3 further shows a further optional mixer device 9.2 connected with the optional further filter device 7 at an output side of the further filter device 7.

FIG. 4 shows a principle drawing of an apparatus 1 according to a further exemplary embodiment. The exemplary embodiment of the apparatus of FIG. 4 differs from the previous embodiments by an additional audio outputting device 3.2, e.g. embodied as a bass shaker, connected with the optional filter device 7 at an output side of the optional filter device 7.

In the exemplary embodiment of FIG. 4, the optional further filter device 7 can be embodied as a lowpass filter. The further filter device 7 may have a cutoff frequency of 25 Hz. However, other cutoff frequencies are conceivable.

FIG. 5 shows a principle drawing of an apparatus 1 according to a further exemplary embodiment. The embodiment of FIG. 5 generally, indicates that the apparatus 1 may comprise the plurality of audio processing devices 5, a plurality of filter devices (indicated by a box representing a filter bank) connected at an input side of respective audio processing devices 5, and a plurality of filter devices connected at an output side (indicated by a box representing a filter array).

Each apparatus 1 according to the embodiments of the Fig. generally allows for implementing a method for processing an audio signal comprising the following steps:

processing an audio signal comprising a number of non-uniformly spaced sampling points P in a time-dependent representation of the audio signal, particularly in a half-wave representation of the audio signal;

determining an interval I between a first zero-crossing and a further zero-crossing of the audio signal;

determining a first set S1 of sample points P in the interval, the first set S1 of sample points P comprising a number of sample points P at first positions in the interval I;

determining a second set S2 of sample points P in the interval, the second set S2 of sample points P comprising a number of sample points P at second positions in the interval I;

modifying the audio signal in the interval I, on basis of an audio signal modification rule, by changing positions of the sample points P of the first set S1 of sample points P in the interval I such that each sample point P of the first set S1 of sample points P is changed from its respective first position in the first set S1 of sample points P to its respective second position in the second set S2 of sample points P;

applying the modified audio signal interval to the respective interval of the original audio signal so as to generate a modified audio signal.

Each apparatus 1 according to the embodiments of the Fig. generally allows for implementing a method for outputting an audio signal, particularly in a vehicle cabin, comprising the following steps:

processing an audio signal comprising a number of non-uniformly spaced sampling points in a time-dependent representation of the audio signal, particularly in a half-wave representation of the audio signal;

determining an interval I between a first zero-crossing and a further zero-crossing of the audio signal;

determining a first set S1 of sample points P in the interval I, the first set S1 of sample points P comprising a number of sample points P at first positions in the interval I;

determining a second set S2 of sample points P in the interval I, the second set S2 of sample points P comprising a number of sample points P at second positions in the interval I;

modifying the audio signal in the interval I, on basis of an audio signal modification rule, by changing positions of the sample points P of the first set of sample points P in the interval I such that each sample point P of the first set S1 of sample points P is changed from its respective first position in the first set S1 of sample points P to its respective second position in S2 the second set of sample points P;

applying the modified audio signal interval to the respective interval I of the original audio signal so as to generate a modified audio signal;

outputting the modified audio signal, particularly in a vehicle cabin.

One or more specific features of a first exemplary embodiment can be combined with one or more specific features of at least one further exemplary embodiment.

The invention claimed is:

1. Apparatus for processing an audio signal comprising a number of samples to generate missing harmonics of low-frequency components in the audio signal, the apparatus comprising at least one audio processing device configured to:

process the audio signal in a time-dependent representation of the audio signal;

determine an interval between a first zero-crossing and a further zero-crossing of the audio signal;

determine a first set of sample points in the interval, the first set of sample points comprising a number of sample points at first positions in the interval;

determine a second set of sample points in the interval, the second set of sample points comprising a number of sample points at second positions in the interval;

modify the audio signal in the interval, on basis of an audio signal modification rule, by changing positions of the sample points of the first set of sample points in the interval such that the position of each sample point of the first set of sample points is changed from its respective first position in the first set of sample points to its a second position in the second set of sample points;

apply the modified audio signal interval to the respective interval of the original audio signal so as to generate a modified audio signal; wherein the at least one audio processing device is configured to modify the audio signal on the basis of the audio signal modification rule; wherein the audio signal modification rule is or comprises a tilting function, configured to tilt a zero-crossing tangent at the first zero-crossing or at the further zero-crossing of the audio signal in clockwise or counter-clockwise direction.

2. Apparatus according to claim 1, wherein the audio signal modification rule specifies a defined change of the positions of the sample points of the first set of sample points in the interval such that each sample point of the first set of sample points is changed from the respective first position in the first set of sample points to the respective second position in the second set of sample points such that the sample points of the second set of sample points are equally spaced.

3. Apparatus according to claim 2, wherein the audio signal modification rule is or comprises a mapping function, particularly a monotonic mapping function, configured to map input sample points of the first set of sample points having the respective first position to output sample points of the second set of sample points having the respective second position.

4. Apparatus according to claim 1, wherein the audio signal processed by the at least one audio processing device has a specific original waveform, whereby the at least one audio processing device is configured to modify the specific original waveform of the audio signal to at least one target waveform of the audio signal.

5. Apparatus according to claim 4, wherein the at least one audio processing device is configured to modify the specific original waveform of the audio signal on the basis of the audio signal modification rule specifying a defined change of the waveform of the audio signal from its original waveform to at least one target waveform of the audio signal.

6. Apparatus according to claim 4, wherein the target waveform is a symmetric waveform, particularly a rectangular-waveform, a triangle-waveform or a needle-waveform, or an asymmetric waveform, particularly a sawtooth-waveform, preferably a straight or dented falling or rising sawtooth-waveform.

7. Apparatus according to claim 1, wherein the at least one audio processing device is configured to apply a skipping rule or skipping factor according to which at least one zero-crossing between the first zero-crossing and the further zero-crossing is not considered for determining the interval between the first zero-crossing and the further zero-crossing of the audio signal.

8. Apparatus according to claim 1, further comprising at least one first filter device arranged to apply at least one filtering rule on the audio signal before the audio signal is processed by the at least one audio processing device, and/or at least one second filter device arranged to apply at least one filtering rule on the audio signal after the audio signal was processed by the at least one audio processing device.

9. Apparatus according to claim 8, wherein at least one of the at least one first filter device and the at least one second filter device comprises a lowpass filter device.

10. Apparatus according to claim 1, further comprising one or more additional audio processing devices arranged in a parallel arrangement relative to the at least one audio processing device.

11. Apparatus according to claim 10, wherein the one or more additional audio processing devices have different audio signal modification properties than the at least one audio signal processing device and are configured to modify the audio signal on the basis of second audio signal modification rule, by changing positions of the sample points of the first set of sample points in the interval such that each sample point of the first set of sample points is changed from its respective first position in the first set of sample points to a third position in the second set of sample points in accordance with the second audio signal modification rule.

12. Apparatus according to claim 11, wherein the first modification rule of the at least one audio processing device specifies a defined change of the waveform of the audio signal from its original waveform to at least one first target waveform of the audio signal, and the second modification rule of the one or more additional audio processing devices specifies a defined change of the waveform of the audio signal from its original waveform to a second target waveform of the audio signal.

13. Apparatus according to claim 12, wherein the first target waveform of the audio signal is opposite in shape and/or orientation to the at least one further target waveform of the audio signal.

14. Apparatus according to claim 1, wherein the apparatus further comprises a first skipping rule or skipping factor application audio processing device which is configured to apply a first skipping rule or skipping factor according to which the at least one zero-crossing between the first zero-crossing and the further zero-crossing is not considered for determining the interval between the first zero-crossing and the further zero-crossing of the audio signal, and one or more additional skipping rule or skipping factor application audio processing devices which are configured to apply at least one further skipping rule or skipping factor according to which the at least one zero-crossing between the first zero-crossing and the further zero-crossing is not considered for determining the interval between the first zero-crossing and the further zero-crossing of the audio signal.

15. Apparatus according to claim 1, wherein the at least one audio processing device is configured to determine the number of sample points between the first zero-crossing and the further zero-crossing such that it is identical to the number of sample points in the respective interval in the original audio signal.

16. Method for processing an audio signal comprising a number of samples to generate missing low-frequency components in the audio signal, the method comprising:

processing the audio signal in a time-dependent representation of the audio signal;

determining an interval between a first zero-crossing and a further zero-crossing of the audio signal;

determining a first set of sample points in the interval, the first set of sample points comprising a number of sample points at first positions in the interval;

determining a second set of sample points in the interval, the second set of sample points comprising a number of sample points at second positions in the interval;

modifying the audio signal in the interval, on basis of an audio signal modification rule, by changing positions of the sample points of the first set of sample points in the interval such that the position of each sample point of the first set of sample points is changed from a first position in the first set of sample points to a second position in the second set of sample points;

applying the modified audio signal interval to the respective interval of the original audio signal so as to generate a modified audio signal; wherein modifying the audio signal is carried out on the basis of the audio signal modification rule; wherein the audio signal modification rule is or comprises a tilting function, configured to tilt a zero-crossing tangent at the first zero-crossing or at the further zero-crossing of the audio signal in clockwise or counter-clockwise direction.

* * * * *